US007174694B2

(12) United States Patent
Ogger et al.

(10) Patent No.: US 7,174,694 B2
(45) Date of Patent: Feb. 13, 2007

(54) LOADING OBJECTS INTO INDIVIDUAL POCKETS OF A MOVING WEB

(75) Inventors: Egon Ogger, Altheim (DE); Volker Schmid, Oberdishingen (DE)

(73) Assignee: Uhlmann Pac-Systeme GmbH & Co. KG, Laupheim (DE)

( * ) Notice: Subject to any disclaimer, the term of this patent is extended or adjusted under 35 U.S.C. 154(b) by 32 days.

(21) Appl. No.: 11/130,077

(22) Filed: May 16, 2005

(65) Prior Publication Data

US 2005/0257851 A1 Nov. 24, 2005

(51) Int. Cl.
*B65B 35/12* (2006.01)
*B65B 35/32* (2006.01)
*B65B 9/04* (2006.01)

(52) U.S. Cl. ..... 53/235; 53/237; 53/244; 53/246; 53/250

(58) Field of Classification Search ..... 53/235, 53/237, 244, 246, 247, 249, 250, 900; 221/92; *B65B 35/12, 35/32*
See application file for complete search history.

(56) References Cited

U.S. PATENT DOCUMENTS

| | | | | |
|---|---|---|---|---|
| 4,094,129 | A * | 6/1978 | List | 53/54 |
| 4,627,225 | A * | 12/1986 | Faller et al. | 53/510 |
| 6,510,676 | B1 | 1/2003 | Gauthier | |
| 6,648,575 | B2 * | 11/2003 | Baroncini | 414/300 |

FOREIGN PATENT DOCUMENTS

| | | | |
|---|---|---|---|
| DE | 2 055 598 | | 5/1971 |
| DE | 2262951 | A * | 6/1974 |
| DE | 3842273 | | 6/1989 |
| DE | 10026496 | A * | 11/2001 |
| EP | 1380510 | | 1/2004 |
| JP | 02127223 | A * | 5/1990 |
| JP | 03000618 | A * | 1/1991 |
| WO | WO-971184 | | 4/1997 |

OTHER PUBLICATIONS

"VERPACKUNGSMASCHINE", Mar. 9, 1967; (Feb. 20, 1969-6600893) Hofliger & Karg; pp. 1-7.
"German Office Action", Munchen Nov. 22, 2004, 3 pages.

* cited by examiner

*Primary Examiner*—Stephen F. Gerrity
(74) *Attorney, Agent, or Firm*—Andrew Wilford

(57) ABSTRACT

A conveyor advances a web horizontally parallel to rows of upwardly open pockets formed in the web underneath a loader having a plurality of object-filled passages each having a downwardly open mouth open immediately above a respective one of the rows of pockets. As the sheet is advanced underneath the loader the objects drop out of the mouths into the pockets. Respective arms are pivotal on the loader downstream of the mouths at each of the rows about a horizontal transverse axis and have upwardly deflectable lower ends normally positioned immediately above the sheet. These lower arm ends are horizontally engageable with any of the objects projecting upwardly out of the respective pocket so that, as the sheet is advanced, the arm lower ends horizontally strikes any upwardly projecting objects and then pivots up while sliding the projecting object up out of the respective pocket.

10 Claims, 3 Drawing Sheets

LOADING OBJECTS INTO INDIVIDUAL POCKETS OF A MOVING WEB

FIELD OF THE INVENTION

The present invention relates to an apparatus for loading objects into individual pockets of a moving web. More particularly this invention concerns an apparatus for putting pills, capsules, or the like into individual blisters of a continuous sheet.

BACKGROUND OF THE INVENTION

In the packaging of small relatively hard objects such as pills, capsules, lozenges, and the like it is necessary to first order the objects in a row. German 2,055,598 of List describes a complex machine for doing this. Then the objects are fed in rows through individual passages down to a passing sheet or web formed with a plurality of longitudinally extending rows of upwardly open pockets or blisters. Each feed passage opens immediately above a respective one of the rows of pockets so that, as the sheet moves horizontally past, the lowermost object in each passage will drop into the pocket. Under ideal circumstances each object will generally fill the respective pocket generally up to the plane of the top face of the sheet, so that the object immediately above it in the passage will be held up until the sheet advances and the next pocket aligns with the passage and it can move down. German utility model 6,600,893 describes a system for detecting that the pockets are properly filled, and U.S. Pat. No. 4,090,610 describes an arrangement for pushing aside filled packages that are too big.

It is, however, fairly common for the objects, particularly when they are pills, to break into two or more parts. In this situation a fragment of an object will lodge in the pocket, and part of the trailing object will also fit down into the pocket and be entrained downstream as the sheet is advanced. There will therefore be a pocket with an object projecting upward above the plane of the upper face of the sheet formed with the pockets. An attempt to scrape off or remove this partially projecting object can damage the sheet or break the object. Alternately, if it is left in place and an attempt is made to seal a top foil down over the sheet and thereby upwardly close the pockets and seal in the objects, the top foil cannot fit in place and will be held up, spoiling the entire package and possibly tearing the top foil.

OBJECTS OF THE INVENTION

It is therefore an object of the present invention to provide an improved system for loading objects into individual pockets of a moving web.

Another object is the provision of such an improved system for loading objects into individual pockets of a moving web that overcomes the above-given disadvantages, in particular that ensures that no object will be left partially lodged in a pocket.

SUMMARY OF THE INVENTION

An apparatus for loading objects into respective pockets of a web formed with a plurality of rows of the pockets has according to the invention a conveyor for advancing the web horizontally and longitudinally generally parallel to the rows of pockets in a longitudinal transport direction with the pockets open upward underneath a loader having a plurality of passages each having a downwardly open mouth open immediately above a respective one of the rows of pockets. The passages each hold a row of the objects so that as the sheet is advanced underneath the loader the objects drop out of the mouths into the pockets. Respective arms are pivotal on the loader downstream of the mouths at each of the rows about a horizontal axis generally perpendicular to the direction and have upwardly deflectable lower ends normally positioned immediately above the sheet. These lower arm ends are horizontally engageable with any of the objects projecting upwardly out of the respective pocket so that, as the sheet is advanced, the arm lower end horizontally strikes the objects and then pivots up while sliding the projecting object up out of the respective pocket.

With this system therefore the upwardly deflectable arms serve to gently slide objects out of pockets they do not fit into. This happens typically when a broken object has partially filled a pocket so that the following intact object can only partially fit into the pocket, as the pockets are typically dimensioned to hold no more than one such object. The object is pushed rearward by the lower arm end that is free to pivot upward so that it will first tip up the object, than slide it rearward until it is completely out of the pocket, leaving the intact object sitting on the land area between adjacent pockets while the arm passes over it. Once the object is flat, its upper surface is horizontal and the arm lower end can easily move back over it.

According to the invention the arm pivot axis is downstream in the direction from the arm lower ends and the arm lower ends are immediately downstream of the respective passage mouth. This makes the device particularly compact and ensures accurate positioning of the clearing arms. Other systems are known having arms that serve to detect whether a pocket is full or empty, but none have a system where the arms actually serve to clear a pocket of an object that is only partially lodged in the pocket.

To treat the objects being tipped back and pushed out of the pockets as gently as possible, according to the invention each arm lower end carries a roller rotatable about a horizontal roller axis generally perpendicular to the direction. Thus once the object is tipped back and pushed onto the surface of the sheet downstream of its pocket, the roller will simply pass over it.

While in theory the lower arm ends could actually ride on the upper face of the sheet, according to the invention the loading apparatus further an abutment on the loader engageable with the arms and positioned to limit downward displacement of the arm lower ends beyond a position with the lower ends generally at an upper surface of the sheet. Thus the lower arm ends will not actually bear with any significant force on the sheet and may in fact sit a very small distance above it, preventing the arms from scratching the sheet or touching objects fully lodged in their pockets.

Furthermore according to the invention there is means for biasing the lower arms end downward toward the abutment. This biasing unit includes a spring of variable spring force. This makes it possible to exactly tailor the force the arm ends exert downward against the protruding objects, so that even fairly fragile pills or the like can be handled appropriately.

In accordance with the invention means, for example a rotatable brush, is provided downstream of the arms for clearing from the sheet objects slid out of the pockets by the arms.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
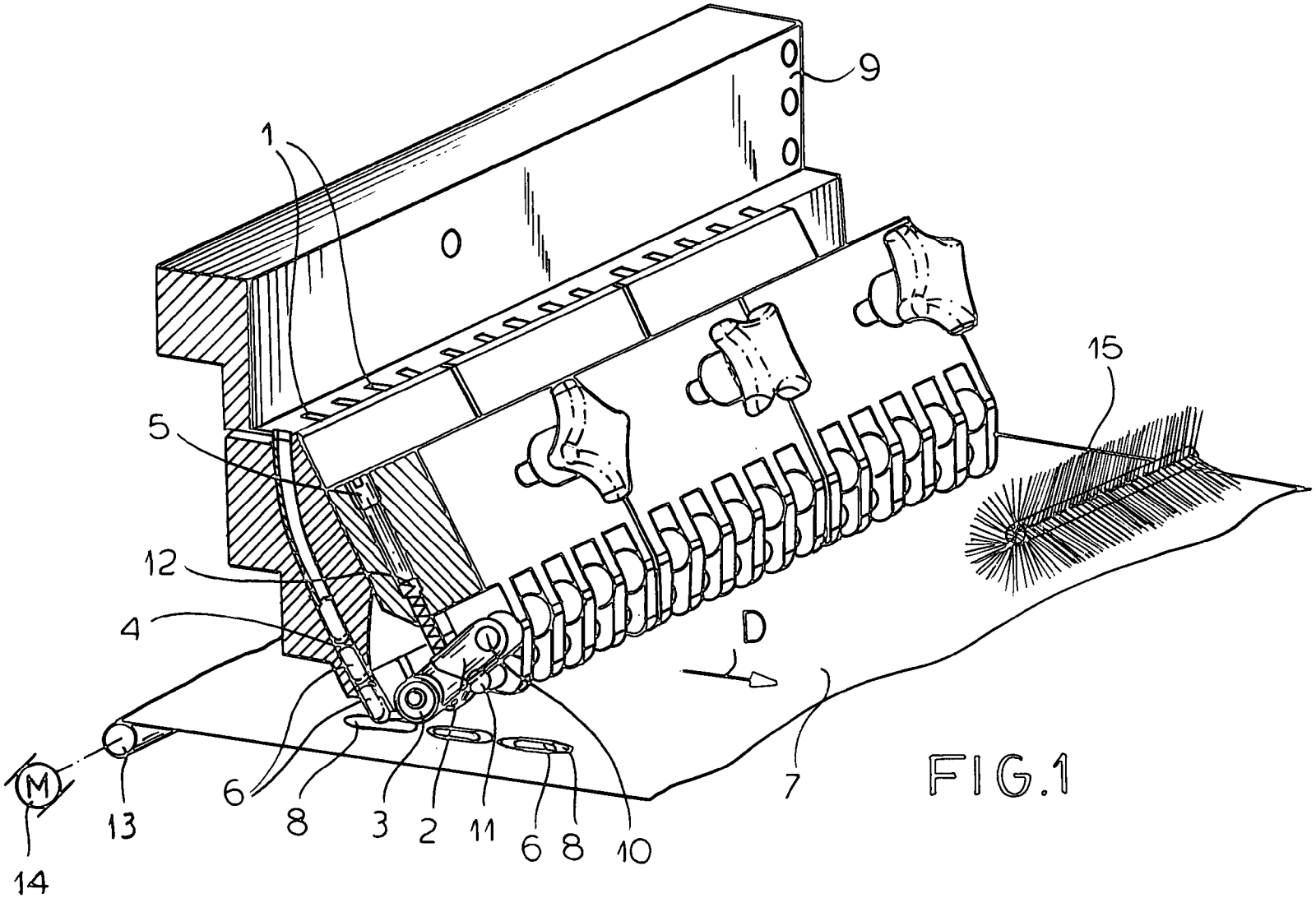
FIG. 1 is a partially diagrammatic and perspective view of the apparatus according to the invention.

As seen in FIG. 1 a sheet 7 formed with a plurality of transversely spaced and longitudinally extending rows (only one shown) of pockets 8 is advanced by a roller 13 operated by a drive motor 14 in a horizontal and longitudinal transport direction D underneath a so-called loading shoe 9. Respective rows of objects, here pills 6, are fed through respective passages 1 in the shoe 9, each passage 1 being aligned with a respective one of the rows of pockets 8 on the sheet 7 end having a downwardly open mouth 4 open immediately above an upper face of the sheet 7. This is substantially standard and serves under normal circumstances to drop a pill 6 into each of the pockets 8. Since the pills 6 are roughly the same size as the pockets 8, once a pill 6 is in a pocket 8, it lies below the plane of the upper face of the sheet 7 and prevents the following pill 6 in the respective passage 8 from moving downward. Only when a new empty pocket 8 is moved underneath each of the mouths 4 can the next pill 6 drop into the pocket.

Figure 2:
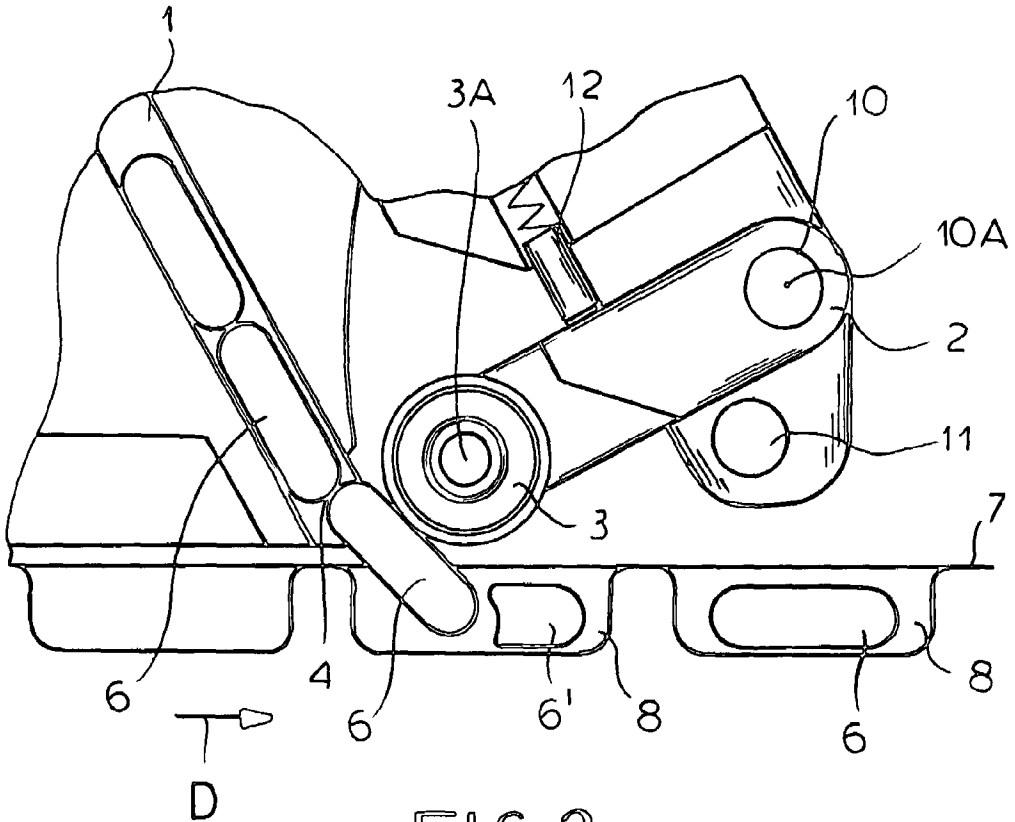
FIGS. 2 and 3 are large-scale side views showing operation of the object in accordance with the invention.

The instant invention is aimed at the situation where as shown in FIG. 2 a broken pill 6' drops down into one of the pockets 8. This makes it possible for the succeeding pill 6 to drop down and lodge partially in the pocket 8 holding the broken pill 6' but, since the pocket 8 is not big enough to completely hold the intact pill 6 and partial pill 6', the pill 6 is left projecting upward above the sheet 7. If this condition is not corrected an attempt to cover the top of the sheet 7 with a planar foil will fail, and an attempt to scrape off the upwardly projecting pill 6 might damage the foil 7.

According to the invention, immediately downstream of is each mouth 4 is a short rigid arm 2 having an upper downstream end mounted on a rod 10 for pivoting about a horizontal axis 10A perpendicular to the direction D. Each arm 7 has a lower upstream end carrying a cylindrical roller 3 rotatable about an axis 3A parallel to the axis 10A. Each such arm 2 is urged downward by a spring 12 whose spring force is adjusted by a respective screw 5. An abutment 11 is provided on the loader shoe 9 so that, in a lowermost position of the arm 2, its roller 3 rides slightly above the upper face of the sheet 7.

Figure 3:
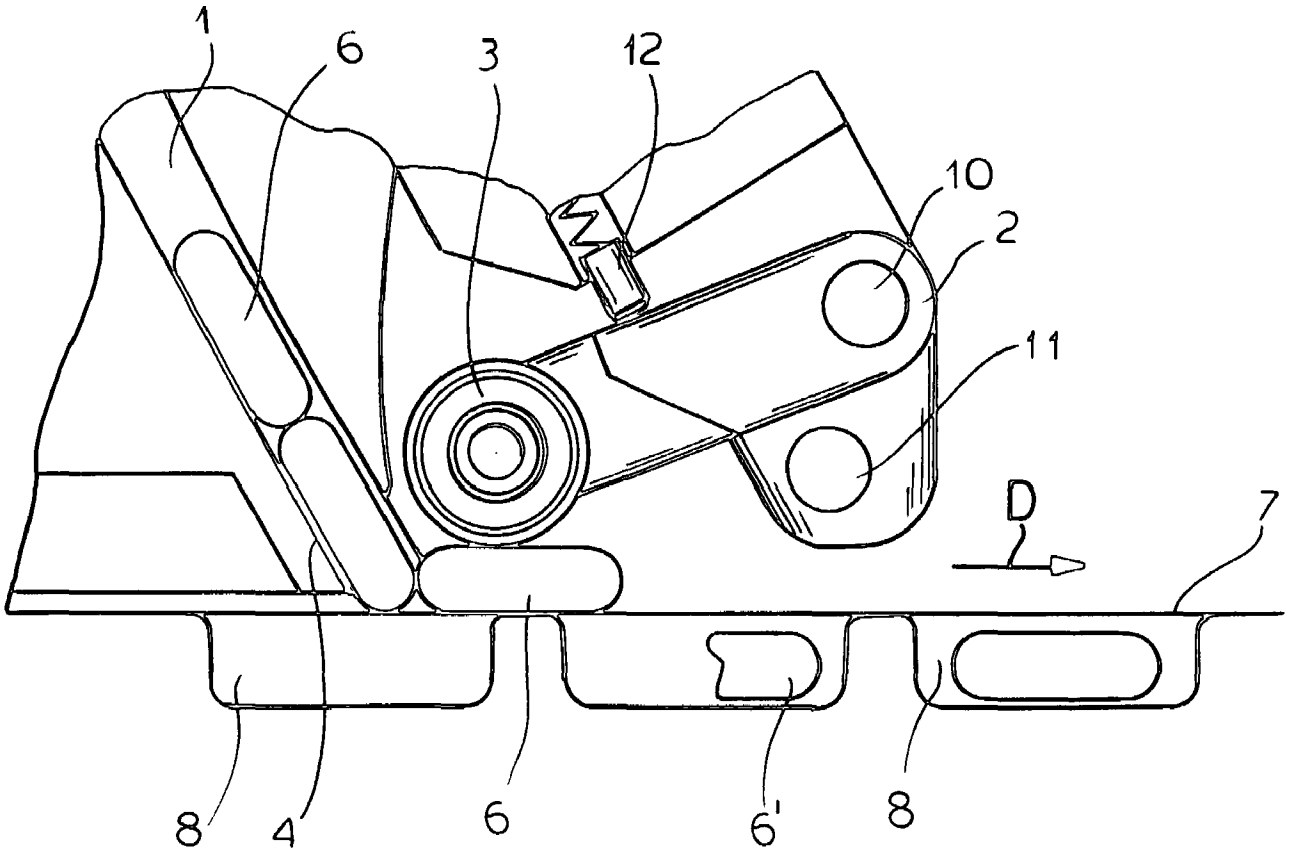

Thus when one of the rollers 3 engages a pill 6 projecting upward from one of the pockets 8, it will tip it backward as shown in FIG. 2 and will shift it so that it either drops down into the following pocket or is left sitting on the sheet 7 between two of the pockets 8 as shown in FIG. 3. In the latter case a rotary brush 15 shown partially at 15 can serve to push it out of the way.

We claim:

1. An apparatus for loading objects into respective pockets of a web formed with a plurality of rows of the pockets, the apparatus comprising:

means for advancing the web horizontally and longitudinally generally parallel to the rows of pockets in a longitudinal transport direction with the pockets open upward;

a loader having a plurality of passages each having a downwardly open mouth open immediately above a respective one of the rows of pockets, the passages each holding a row of the objects, whereby as the sheet is advanced underneath the loader the objects drop out of the mouths into the pockets; and respective arms pivotal on the loader downstream of the mouths at each of the rows about a horizontal axis generally perpendicular to the direction and having upwardly deflectable lower ends normally positioned immediately above the sheet and horizontally engageable with any of the objects projecting upwardly out of the respective pocket, whereby the arm lower end horizontally strikes the objects and then pivots up while sliding the projecting object up out of the respective pocket.

2. The loading apparatus defined in claim 1 wherein the axis is downstream in the direction from the arm lower ends and the arm lower ends are immediately downstream of the respective passage mouth.

3. The loading apparatus defined in claim 1 wherein each arm lower end carries a roller rotatable about a horizontal roller axis generally perpendicular to the direction.

4. The loading apparatus defined in claim 1, further comprising an abutment on the loader engageable with the arms and positioned to limit downward displacement of the arm lower ends beyond a position with the lower ends generally at an upper surface of the sheet.

5. The loading apparatus defined in claim 4, further comprising means for biasing the lower arms end downward toward the abutment.

6. The loading apparatus defined in claim 5 wherein the biasing means includes a spring.

7. The loading apparatus defined in claim 6 wherein a force of the spring is adjustable.

8. The loading apparatus defined in claim 1, further comprising means downstream of the arms for clearing from the sheet objects slid out of the pockets by the arms.

9. The loading apparatus defined in claim 8 wherein the clearing means includes a rotatable brush.

10. The loading apparatus defined in claim 1 wherein there is one such arm for each passage of the loader.

* * * * *

UNITED STATES PATENT AND TRADEMARK OFFICE

CERTIFICATE OF CORRECTION

PATENT NO. : 7,174,694 B2
APPLICATION NO. : 11/130077
DATED : February 13, 2007
INVENTOR(S) : Egon Ogger et al.

It is certified that error appears in the above-identified patent and that said Letters Patent is hereby corrected as shown below:

On the Title Page Item (30) insert

-- - Foreign Application Priority Data

May 24, 2004 (DE) ..... 10 2004 025 840.6 --

Signed and Sealed this

Twenty-fourth Day of April, 2007

JON W. DUDAS
*Director of the United States Patent and Trademark Office*